US006041730A

United States Patent [19]

Oliverio et al.

[11] Patent Number: 6,041,730

[45] Date of Patent: Mar. 28, 2000

[54] SHALLOW WATER ANCHOR

[75] Inventors: John Oliverio, Brandon; Leonard T. Mriscin, Tierra Verde, both of Fla.

[73] Assignee: JL Marine Systems, Inc., Brandon, Fla.

[21] Appl. No.: 09/299,204

[22] Filed: Apr. 23, 1999

[51] Int. Cl.[7] ..... B63B 21/24

[52] U.S. Cl. ..... 114/294; 114/230.13; 440/36

[58] Field of Search ..... 114/293, 294, 114/295, 230.13; 440/36

[56] References Cited

U.S. PATENT DOCUMENTS

| | | | |
|---|---|---|---|
| 16,704 | 2/1857 | Cumming, Jr. | 440/36 |
| 0,458,473 | 8/1891 | Macdonald | 114/142 |
| 2,816,521 | 12/1957 | Alexander | 114/145 R |
| 2,863,415 | 12/1958 | Schofield | 114/297 |
| 3,046,928 | 7/1962 | Sherrill | 114/145 R |
| 4,237,808 | 12/1980 | Doerffer | 114/145 R |
| 4,702,047 | 10/1987 | Stokes | 114/294 |
| 4,960,064 | 10/1990 | Mestas et al. | 114/293 |

*Primary Examiner*—Jesus D. Sotelo
*Attorney, Agent, or Firm*—David Kiewit

[57] ABSTRACT

A shallow water anchoring mechanism for a vessel drives an upper arm between a raised position, in which the lower end of a pole is above the bottom of the hull and a lowered position, in which the lower end of the pole extends downward below the vessel so as to engage the bottom of a shallow body of water. This provides a shallow-water anchoring arrangement for a boat that does a minimum amount of damage to sea life, including oysters, and grasses or other vegetation growing on the bottom of the water, and allows a boater to anchor in shallow water and to leave the anchorage without bringing mud, grasses, or other debris into the boat. A manual disconnect arrangement allows the boater to pull the pole out of the water in the event of actuator or power supply failure.

14 Claims, 3 Drawing Sheets

SHALLOW WATER ANCHOR

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The invention relates to anchoring devices for marine vessels, and, in particular, to anchors adapted to hold a small boat in a stationary position in shallow water.

2. Background Information

Along much of the Gulf Coast portion of the United States, as well as elsewhere, it is popular to fish from a small boat in shallow water. Along much of the Gulf Coast, in particular, there are extensive shallow, grassy-bottomed regions, generally referred to as "flats", that are populated by various sports fish. Fishermen who fish the flats have heretofore employed several methods of holding a boat at a selected location. These approaches include the use of conventional anchors, as well as the use a pole shoved into the bottom and secured to the boat.

The use of anchors (e.g., of the popular Danforth or spud types) by flats fishermen has several shortcomings. One problem is that the boat's position is not firmly fixed and it can drift about at the end of the anchor line, which may conventionally be some fifteen meters long. Another problem is that in both setting and retrieving an anchor the anchor's flukes rip sea grass out of the bottom and thereby cause significant ecological damage. Yet a further problem is that when the anchor is hauled in, mud and sea grass from the anchor foul the inside of the boat.

Poles are sometimes used to manually propel a flats fishing boat (e.g., when trying to approach fish that would be spooked by the sound of an engine). In these cases, the fisherman may provide some sort of pole-retaining hardware (e.g., a vertically disposed pipe having two open ends and a diameter substantially greater than that of the pole may be fastened to the boat hull) to hold the boat to the pole after the pole is thrust more or less vertically into the bottom. Such arrangements fix the position of the boat much more securely, and cause substantially less damage to sea grass beds than does anchoring. This approach is not widely used, as poling is slow and laborious, and the great majority of flats fishermen do not carry or use poles.

Notable in the patent art in this area is U.S. Pat. No. 0,458,473 wherein MacDonald describes a jointed structure hinged to a submergible coastal artillery battery and comprising a pole inserted into the bottom of a shallow body of water. Other elongate pole-like anchoring mechanisms not hingedly secured to a vessel are taught by Mestas et al. in U.S. Pat. No. 4,960,064 and by Stokes in U.S. Pat. No. 4,702,047. Mechanisms other than anchors that are hingedly attached to a vessel hull are taught, inter alia, by Alexander, in U.S. Pat. No. 2,816,521 and by Sherrill in U.S. Pat. No. 3,046,928, both of whom show stem stabilizers, and by Doerffer, in U.S. Pat. No. 4,237,808, who shows a braking device.

BRIEF SUMMARY OF THE INVENTION

In a preferred embodiment, the invention provides an anchoring mechanism for a vessel, the mechanism comprising upper and lower arms and an actuator to drive the arms between a raised position, in which the lower end of the lower arm is above the bottom of the hull and a lowered position, in which the lower end of the lower arm extends downward below the vessel so as to engage the bottom of a shallow body of water. In some preferred embodiments the actuator is a powered linear actuator driven by an electric storage battery. In other preferred embodiments the actuator may be a manually powered linear actuator.

One of the benefits of the invention is that it provides a shallow-water anchoring arrangement for a small boat that does a minimum amount of damage to sea grasses, other vegetation, or other sea life, such as oysters, growing on the bottom.

Another benefit of the invention is that it allows a boater to anchor in shallow water and to leave the anchorage without bringing mud or other debris into the boat A further benefit of some preferred embodiments of the invention is the provision of apparatus and method for anchoring a small boat in shallow water without requiring physical exertion on the part of the boater.

Moreover, in some embodiments of the invention means of partially disassembling the apparatus without the use of tools is provided so that a boater can raise a failed anchoring mechanism from the bottom.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figure 1:
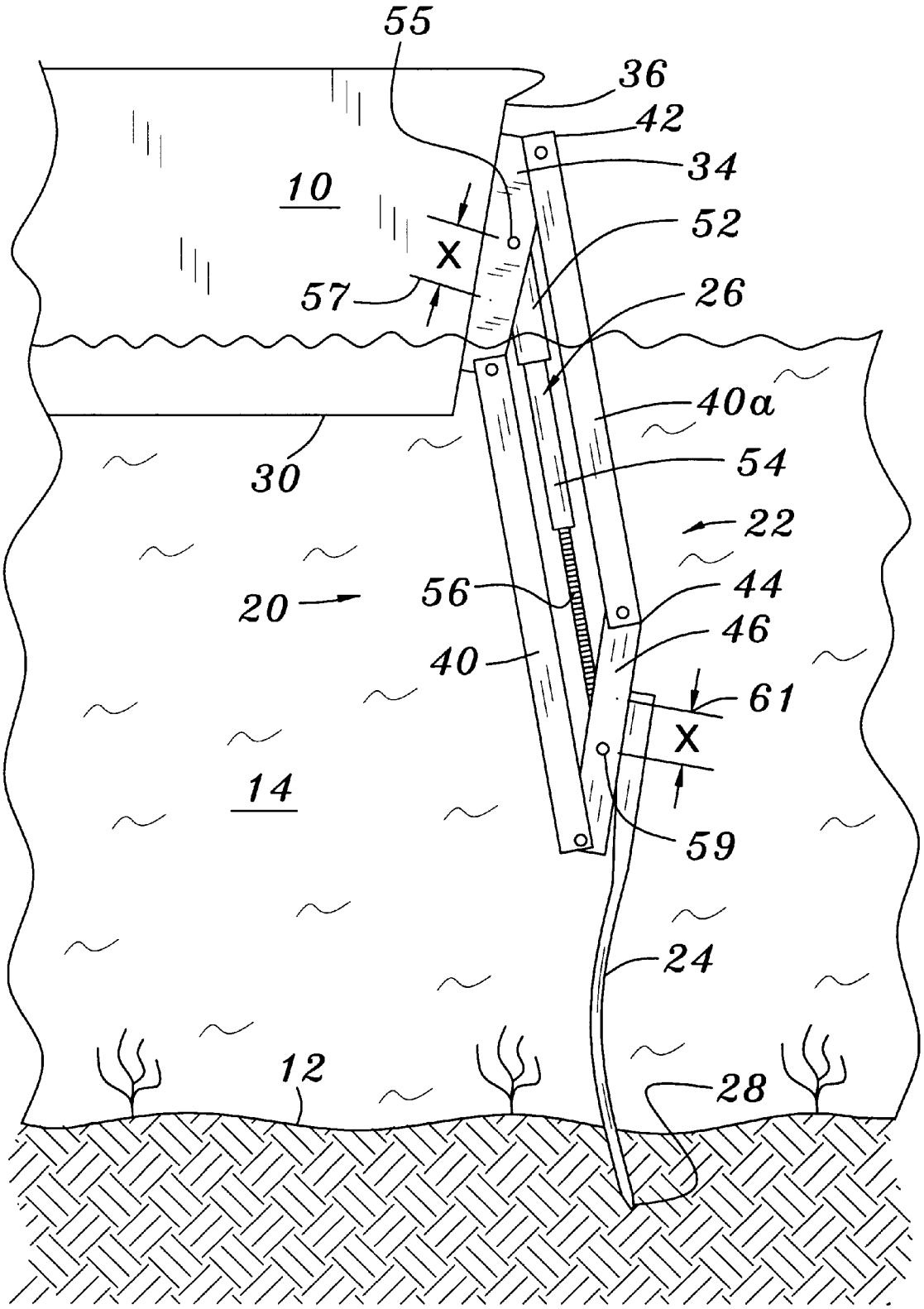
FIG. 1 is a side elevational view showing apparatus of the invention anchoring a boat.

A boat 10 may be anchored to the bottom 12 of a shallow body of water 14 by apparatus of the invention 20 comprising an upper arm 22, preferably configured as a partially skeletal parallelpiped, a lower arm that is preferably a flexible pole 24 adapted to be thrust into the bottom 12, and an actuator 26 adapted to move the upper arm 22 between a raised position in which the lower end 28 of the pole 24 is preferably above the bottom 30 of the boat's hull 32 and a lower position in which the lower end 28 of the pole 24 is thrust downwardly so as to engage the bottom 12 if the body of water 14 is shallow enough.

A preferred upper arm 22 is configured as a parallelpiped having four elongate framed faces and two shorter end faces, which may be made from either solid sheets of material or which may comprise a plurality of framing members extending about the peripheries thereof. An end face proximal the vessel 10, hereinafter referred to as the "base" 34, may be fixedly attached to the hull 32 of the boat 10, preferably on the outside of the transom 36, and may be offset to port or starboard from a centerline of the hull to avoid interference with an engine 38 or other power train. In the preferred embodiment four elongate framing members 40 are respectively hingedly attached at one end 42 to the base 34 and at each respective other end 44 to the second end face 46 which is distal from the vessel 10. The second end face 46 may be a solid plate, or may be a famed face comprising four shorter framing members. In one preferred embodiment, the end plates 42, 46 and elongate framing members 40 are made from a corrosion resistant metal.

An elongated pole 24, which is preferably made of a fiber-reinforced plastic material, is attached by suitable means to the second end face 46. In one preferred embodiment the pole 24 is attached to the second end face 46 by two bolts. As depicted in FIG. 1, lateral forces acting on the boat 10 are imposed on the pole 24. Hence, it is preferred that the pole 24 be able to flex elastically over an appreciable range. A variety of materials have been used successfully for the pole. Tests to date have indicated that a preferred pole may be a solid rod having a diameter ranging from one half to one inch and having a length of thirty to thirty six inches.

Figure 2:
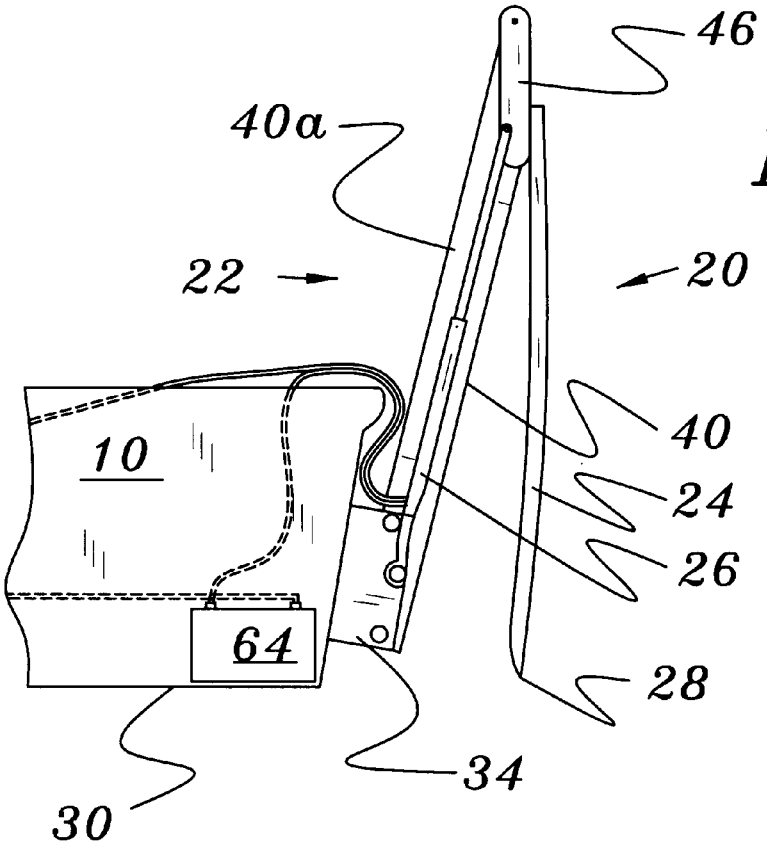
FIG. 2 is a side elevational view showing apparatus of the invention in a raised and stowed position.

A preferred linear actuator 26 comprises a controllably variable length portion 27. When the preferred actuator is connected between the end plates 34, 46 as hereinafter described, changing the length of the variable length portion 27 serves to move the upper arm 22 between its raised and its lowered positions. The preferred actuator 26 is disposed along a line skewed from a face diagonal of the parallelpipedal arm 22 so that extending the linear actuator 26 collapses the parallelpiped in the sense shown in FIG. 1, which drives the pole 24 downward; whereas contracting the linear actuator collapses the parallelpiped in the opposite sense, which raises the pole 24, as depicted in FIG. 2. As shown in the drawing, in a preferred embodiment the actuator 26 is not exactly parallel to a face diagonal, but is somewhat displaced from that position at both ends so that an upper end of the actuator 26 is pivotally attached to the base plate 34 adjacent an upper end thereof, and the lower end of the actuator 26 is pivotally attached to the second end 46 adjacent a lower end thereof. In order to get the benefit of full travel of the actuator 26, the location of the upper pivotal attachment point 55 of the actuator 26 is chosen to be above a vertical center 57 of the base 34 by a distance, denoted by "x" in FIG. 1, that is equal to one third of the actuator's full range travel. Correspondingly, the location of the lower pivotal attachment point 59 is spaced below the vertical center 61 of the second end face 46 by the same distance.

Although the preferred embodiment places the actuator 52 within the upper arm 22, other arrangements are possible. In an alternate embodiment depicted in FIG. 2, a linear actuator 52 having a variable length portion may be disposed alongside, rather than within, the upper arm 22.

The preferred linear actuator 26 may comprise an electric motor 52 that turns an internally threaded member 54 on a lead screw 56, or may comprise an electric motor driving a hydraulic pump supplying fluid to a telescoping rod assembly. In some embodiments of the invention, which are particularly adapted to be used on small boats that may not have a source of electric power on board, any of a variety of known manually operated linear actuators may be employed. Such actuators include, but are not limited to, manually cranked lead screw mechanisms, manually pumped hydraulic or pneumatic telescoping rod assemblies, and lever-operated mechanism similar to those used in draw-type latches. Moreover, it will be understood to those skilled in the arts that many sorts of actuators could be used other than the preferred variable length actuator. These include, inter alia, a winch (not shown) mounted on the boat and having a rope or cable extending from the winch to the distal end of the upper arm. Actuators having a variable length portion are preferred because they can be installed within the upper arm, as discussed supra, thereby yielding a compact mechanism having no protruding parts interfering with the use of the boat.

In a preferred electrically-powered embodiment, the actuator 26 is controlled by a controller 58 having a command input from a remote user control 60 operable from a forward console or other location on the boat 12 distal from the actuator. It will be understood that a wide variety of user controls, ranging from a simple switch to an infra-red pulse transmitter of the sort commonly used to control television sets can be employed in the system. Additionally, a preferred embodiment of the invention may comprise a load sensing means 62 usable to stop the downward motion of the pole 24 when significant resistance to further motion is encountered—e.g., when the lower end of the pole engages a hard bottom. A variety of load sensing means are known in the control arts and encompass strain measurements made on the pole 24 and electrical measurements made on the motor 52.

Figure 4:
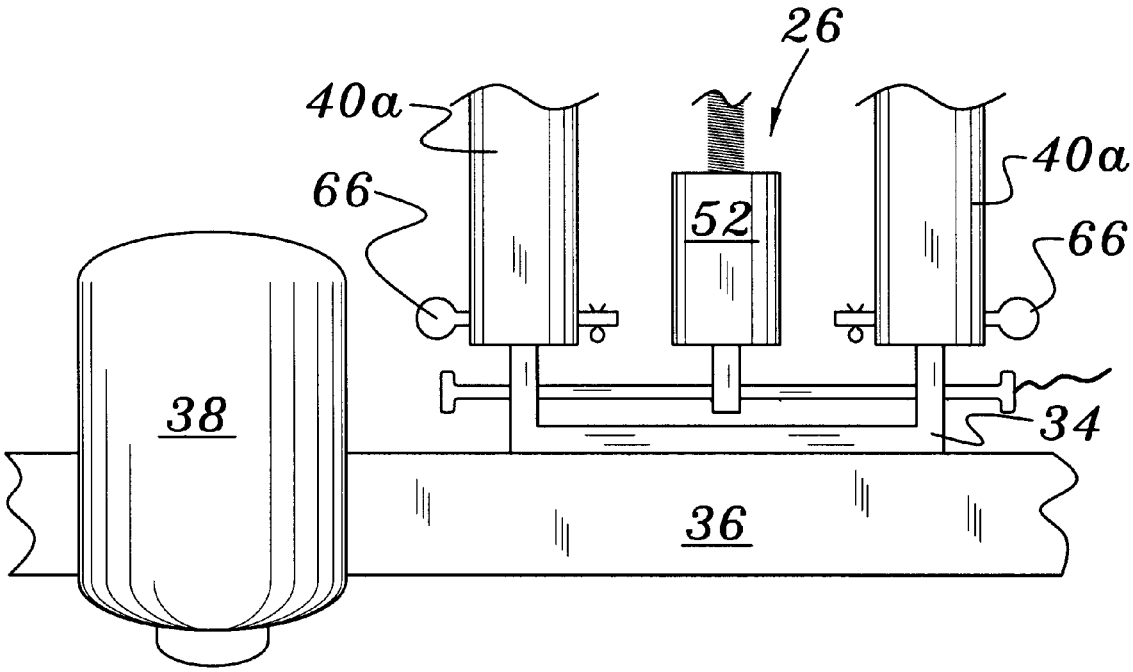
FIG. 4 is a partial plan view of the stern of a boat that has apparatus of the invention attached thereto.

It is important to consider the effect of power failures in electrically actuated embodiments and of actuator failures on the overall operation of the anchoring means 20. It would, for example, be highly undesirable to anchor the boat 10 by means of the apparatus of the invention 20 and then be unable to pull the pole 24 out of the bottom 12 because a power supply (e.g., the same battery 64 used for starting the boat's engine 38) had been exhausted. A manual means of raising the pole 24 is therefore supplied in a preferred powered embodiment of the invention so that if a boater exhausts the battery 64 while trying to start the engine 38, he or she can manually raise the pole 24 so that the boat 10 can be towed by another vessel. A preferred manual means for raising the pole comprises means for partially disassembling the apparatus without the use of tools so that the lower arm 24 can be raised manually by an operator. In a preferred embodiment this is done by using readily removable pins 66 to hingedly connect the upper ends of the two upper framing members 40*a* to the base plate 34, as depicted in FIG. 4. Thus, even if the actuator 26 is in its fully extended position, a boater can remove the pins 66, grasp the upper framing members 40*a*, manually pull the pole 24 out of the bottom 12, and secure the partially disassembled anchoring apparatus 20 in the somewhat ungainly, but highly towable attitude depicted in FIG. 5.

A vertical cross-section through the depicted parallelpipedal upper arm 22 is a parallelogram. It will be noted by those skilled in the art that the apparatus of the invention 20 could use such a parallelogram, rather than a parallelpiped, comprising two elongate framing members. In this embodiment an actuator would be disposed alongside the parallelogram, rather than within a parallelpiped. This arrangement, while using few components and less material than the preferred arrangement, would also be substantially weaker than the preferred parallelpiped configuration.

Figure 5:
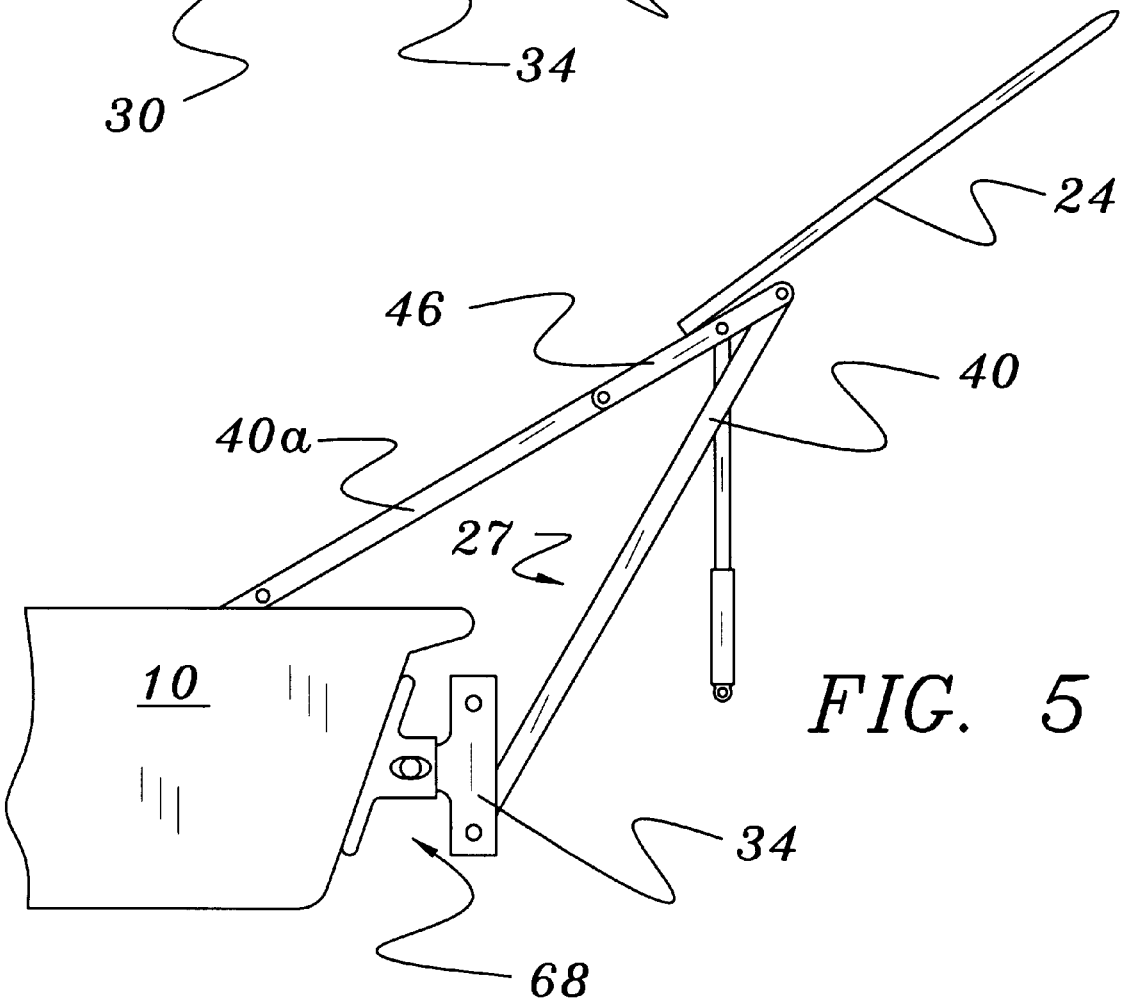
FIG. 5 is a side elevational view of apparatus of the invention in a manually raised position.
Figure 3:
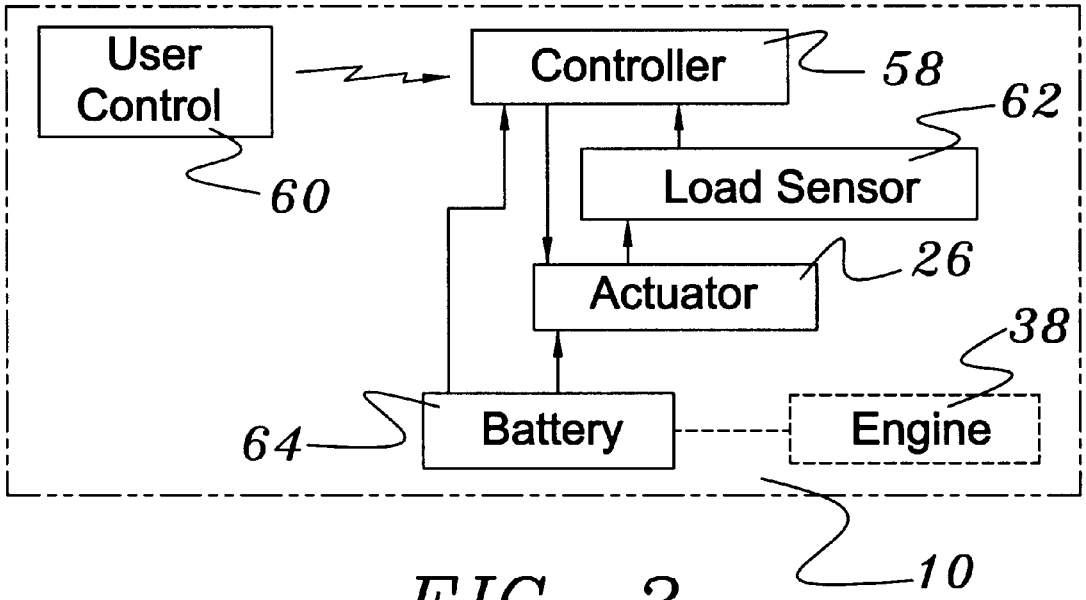
FIG. 3 is a schematic block diagram of a control system.

The disclosure hereinbefore presented has assumed, as a matter of convenience, that the boat 10 with which the apparatus of the invention 20 was to be used, had a generally vertically oriented transom. This is not always the case. As depicted in FIG. 5, some boats have transoms inclined steeply from the vertical. Affixing the base 34 directly to such a transom would require shortening the pole 24 to keep its tip 28 from dragging in the water when the apparatus 20 was in its nominally raised position. To avoid this, a base orienting means 68 may be installed between the base 34 and the tilted transom in order to ensure that the proximal end of the upper arm 22 is vertically oriented. The base orienting means 68 may be a simple wooden wedge, but preferably comprises a combination of a bracket 70 and a receiver 72 providing a variable length base orienting means.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

I claim:

1. Apparatus for anchoring a vessel to a bottom of a body of water, the apparatus comprising:

an upper arm having a proximal end and a distal end, the proximal end of the upper arm attached to a hull of the boat, the proximal end of the arm comprising hinged attachment means whereby the upper arm is adapted to move between a raised position and a lowered position;

a lower arm having a proximal end attached to the upper arm adjacent the distal end thereof, the lower arm having a distal end adapted to engage the bottom when the upper arm is in the lowered position;

an actuator adapted to move the upper arm between the raised and the lowered positions; and means for partially disassembling the apparatus without the use of tools.

2. The apparatus of claim 1 wherein a vertical cross section of the upper arm is a parallelogram and wherein the actuator comprises a portion having a variable length.

3. The apparatus of claim 2 wherein the upper arm is a parallelpiped.

4. The apparatus of claim 1 wherein the actuator comprises a linear actuator comprising a variable length portion.

5. The apparatus of claim 1 wherein the means for partially disassembling the apparatus comprises a pin comprising a portion of the hinged attachment means.

6. The apparatus of claim 1 wherein the lower arm comprises a flexible pole.

7. The apparatus of claim 1 further comprising base orienting means fixedly attached to a tilted transom portion of the hull, the base orienting means selected so that the proximal end of the upper arm is vertically disposed.

8. Apparatus for anchoring a vessel to a bottom of a body of water, the apparatus comprising:

an upper arm comprising at least four members forming a parallelogram having two elongate sides and two shorter sides, wherein each of the members forming one of the elongate sides is pivotally connected adjacent each of its two ends to a respective one of the shorter sides, and wherein a first of the two shorter sides is fixedly attached to a hull of the vessel so that the upper arm is adapted to move in a vertical plane between a raised and a lowered position;

a lower arm attached to the second of the two shorter sides of the upper arm;

an actuator having a variable length portion, the actuator extending between the two shorter sides of the upper arm, the actuator pivotally attached adjacent each of two ends thereof to a respective one of the two shorter sides so that the actuator is adapted to move the upper arm between the raised and the lowered position when the length of the variable length portion of the actuator is changed.

9. The apparatus of claim 8 wherein the upper arm comprises more than four members, the more than four members forming a parallelpiped.

10. The apparatus of claim 9 wherein the actuator is disposed within the parallelpiped.

11. The apparatus of claim 8 wherein the lower arm comprises a flexible pole.

12. The apparatus of claim 8 wherein the actuator comprises a lead screw.

13. The apparatus of claim 8 wherein the actuator comprises a hydraulic pump supplying fluid to a telescoping rod assembly.

14. The apparatus of claim 8 further comprising means for removing a pivotal connection between the first of the two shorter members and one of the elongate members, thereby partially disassembling the apparatus so that the lower arm can be raised manually by an operator.

* * * * *